US010149996B2

(12) United States Patent
Ahdoot et al.

(10) Patent No.: US 10,149,996 B2
(45) Date of Patent: Dec. 11, 2018

(54) STRENGTH-ENHANCING GLOVE

(71) Applicants: Benjamin Ahdoot, Dollard-des-Ormeaux (CA); Simon Ahdoot, Toronto (CA); Eliot Ahdoot, Dollard-des-Ormeaux (CA)

(72) Inventors: Benjamin Ahdoot, Dollard-des-Ormeaux (CA); Simon Ahdoot, Toronto (CA); Eliot Ahdoot, Dollard-des-Ormeaux (CA)

( * ) Notice: Subject to any disclaimer, the term of this patent is extended or adjusted under 35 U.S.C. 154(b) by 0 days.

(21) Appl. No.: 15/150,367

(22) Filed: May 9, 2016

(65) Prior Publication Data

US 2016/0332817 A1 Nov. 17, 2016

Related U.S. Application Data

(60) Provisional application No. 62/160,905, filed on May 13, 2015.

(51) Int. Cl.

| | |
|---|---|
| ***A63B 21/00*** | (2006.01) |
| ***A63B 21/04*** | (2006.01) |
| ***A41D 19/015*** | (2006.01) |
| ***A63B 23/16*** | (2006.01) |

(Continued)

(52) U.S. Cl.

CPC .... *A63B 21/0428* (2013.01); *A41D 19/01582* (2013.01); *A63B 21/022* (2015.10); *A63B 21/4019* (2015.10); *A63B 23/16* (2013.01); *A61H 1/0285* (2013.01); *A61H 2201/165* (2013.01); *A61H 2201/1635* (2013.01);

(Continued)

(58) Field of Classification Search

CPC ..... A61F 13/105; A61F 5/013; A61F 2005/0155; B65G 7/12; A63B 21/00069; A63B 21/0428; A63B 21/4019; A63B 21/022; A63B 21/4025; A63B 23/16; A41D 19/01582; A61H 2205/065; A61H 2201/165; A61H 2201/1635; A61H 1/0285

See application file for complete search history.

(56) References Cited

U.S. PATENT DOCUMENTS 1,235,199 A * 7/1917 Gavin ..... A41D 13/087 15/246

4,675,914 A 6/1987 Mitchell (Continued)

FOREIGN PATENT DOCUMENTS

| | | |
|---|---|---|
| CN | 101870100 | 10/2010 |
| CN | 201630291 | 11/2010 |

(Continued)

*Primary Examiner* — Stephen A Vu

(74) *Attorney, Agent, or Firm* — Benoit & Cote, Inc.; C. Marc Benoit

(57) ABSTRACT

There is described an apparatus for installation on a hand having a thumb and opposable fingers, both having joints and phalanges. The apparatus comprises biasing devices. Each one of the biasing devices substantially has an inversed V shape formed by a hinge, a distal end and a proximal end. The biasing devices are connected together to form the apparatus. The hinges of the biasing devices are spatially distributed so that each hinge covers a corresponding one of the joints and biases the distal end and proximal end toward each other. The apparatus keeps the hand in a substantially closed position to assist in gripping objects.

12 Claims, 4 Drawing Sheets

(51) Int. Cl.
*A63B 21/02* (2006.01)
*A61H 1/02* (2006.01)

(52) U.S. Cl.
CPC .. *A61H 2205/065* (2013.01); *A63B 21/00069* (2013.01); *A63B 21/4025* (2015.10)

(56) References Cited

U.S. PATENT DOCUMENTS 4,765,320 A * 8/1988 Lindemann ..... A61F 5/0118 602/22
4,796,306 A 1/1989 Mitchel
4,949,711 A * 8/1990 Gyovai ..... A61F 5/0118 601/40
5,476,439 A * 12/1995 Robinson ..... A63B 23/16 128/879
6,081,928 A 7/2000 Bourne
6,941,580 B2 9/2005 Kolcio et al.
7,712,153 B2 5/2010 Aams, Jr.
8,029,414 B2 10/2011 Ingvast et al.
8,255,079 B2 8/2012 Linn et al.
8,312,567 B1 11/2012 Valle
8,601,614 B2 * 12/2013 Scaff ..... A61F 5/0118 2/160
8,956,561 B2 2/2015 Lin et al.
2003/0195093 A1 * 10/2003 White ..... A63B 21/0552 482/124
2005/0054487 A1 3/2005 Rogers
2010/0234182 A1 * 9/2010 Hoffman ..... A61B 5/1125 482/8
2012/0204319 A1 8/2012 Gambordella

FOREIGN PATENT DOCUMENTS

CN 202601009 12/2012
CN 203575684 5/2014
CN 203762340 8/2014
CN 203814656 9/2014
CN 203861525 10/2014
JP 2006043179 2/2006
JP 2014114534 6/2014
KR 1020140082177 12/2012
KR 1020140051022 4/2014
WO WO 9501141 A1 * 1/1995 ..... A61F 5/0125

* cited by examiner

STRENGTH-ENHANCING GLOVE

CROSS-REFERENCE TO RELATED APPLICATIONS

This application claims priority from U.S. provisional patent application 62/160,905, filed on May 13, 2015.

BACKGROUND (a) Field

The subject matter disclosed generally relates to strength-enhancing devices. More specifically, it relates to a glove-like apparatus for enhancing the gripping force of a user.

(b) Related Prior Art

Various types of hand-wearable apparatuses for assisting hand movements have been described for different purposes. For example, active grasp-assisting devices were described in U.S. Pat. No. 8,255,079B2 and U.S. Pat. No. 8,029,414B2. These devices require energy sources and command controls which complicate the apparatus and introduce a greater risk of failure. Other gloves, such as the one described in U.S. Pat. No. 8,601,614B2, include elastic bands or springs for training hand muscles. These gloves are designed for training only and are not suited for object handling.

Other existing devices are directed to physical therapy. These apparatuses are designed to assist the user during their movement: when the movement is initiated, the apparatus aids in pursuing the movement with minimal effort. These devices are not suited for constant object handling, for which the closed-hand position is the default position.

Furthermore, most of these apparatuses are bulky and involve some parts of the apparatus being in the palm of the hand or inner surface of the fingers, such as in U.S. Pat. No. 4,796,306A, a situation inhibiting freedom of movement or impeding the grabbing of objects by the hand and fingers.

Other existing apparatuses are designed to have the fingers flex, such as the one described in U.S. Pat. No. 4,675,914A. The apparatus described therein makes the finger bend as a whole from the metacarpophalangeal joint.

There is thus a need for a non-electrically actuated assisting device, which would leave the inner hand free and would assist users in holding heavy objects for long periods with minimal effort.

SUMMARY

According to an aspect of the invention, there is provided an apparatus for installation on a hand having a thumb and opposable fingers, both having joints and phalanges, the apparatus comprising biasing devices, each one of the biasing devices substantially having an inversed V shape formed by a hinge, a distal end and a proximal end, wherein the biasing devices are connected together to form the apparatus, the biasing devices being spatially distributed so that each hinge covers a corresponding one of the joints and biases the distal end and proximal end toward each other for keeping the hand in a substantially closed position.

According to an embodiment, the biasing devices to be installed on one of the thumb and the opposable fingers are integrally connected.

According to an embodiment, the biasing devices to be installed on one of the thumb and the opposable fingers are distinct and connected by a ring between each one of the biasing devices, each ring being for installation one of the phalanges.

According to an embodiment, there is further provided a hand support substantially covering an outer portion of the hand, the hand support comprising anchors, wherein the most proximal ones of the biasing devices of each opposing finger are connected to the hand support via a corresponding one of the anchors.

According to an embodiment, there is further provided a thumb support substantially covering a thumb metacarpal bone, the thumb support being hingedly connected to the hand support and comprising a thumb anchor, wherein the most proximal ones of the biasing devices of the thumb is connected to the thumb support via the thumb anchor.

According to an embodiment, the biasing devices comprise torsional springs.

According to an embodiment, there is further provided an inner glove to act as a protecting layer between the biasing devices and the hand.

According to an embodiment, there is further provided an outer glove to act as a protecting layer over the biasing devices.

According to another aspect of the invention, there is provided an apparatus for assisting in gripping an object by a hand having joints and phalanges, the apparatus comprising a biasing devices, each one of the biasing devices substantially covering a corresponding one of the joints, each one of the biasing devices having a supporting base which is proximal the corresponding one of the joints and exerting a force at location distal the corresponding one of the joints, each one of the biasing devices having a pre-formed hinge on the corresponding one of the joints, wherein a force is required to open each hinge.

According to an embodiment, the biasing devices to be installed on a given finger are integrally connected.

According to an embodiment, there is further provided a ring between each one of the biasing devices, wherein the biasing devices to be installed on a given finger are distinct and connected by the ring, each ring being for installation one of the phalanges, each ring being for at least one of: providing the supporting base for one of the springs; and providing the location where the force is exerted by another one of the springs.

According to an embodiment, there is further provided a hand support substantially covering an outer portion of the hand, the hand support comprising anchors, wherein the most proximal ones of the biasing devices of each opposing finger are connected to the hand support via a corresponding one of the anchors.

According to an embodiment, there is further provided a thumb support substantially covering a thumb metacarpal bone of a thumb of the hand, the thumb support being hingedly connected to the hand support and comprising a thumb anchor, wherein the most proximal ones of the biasing devices of the thumb is connected to the thumb support via the thumb anchor.

According to an embodiment, the biasing devices are torsional springs.

According to an embodiment, there is further provided an outer glove covering the apparatus.

According to an embodiment, there is further provided an inner glove to act as a protecting layer between the biasing devices and the hand.

According to an embodiment, there is further provided an outer glove to act as a protecting layer over the biasing devices.

According to another aspect of the invention, there is provided an apparatus for assisting in gripping an object by a hand, the apparatus comprising: a hand support for covering a portion of a surface of the hand; a torsional spring having a proximal end and a distal end, the proximal end being fixed and located on the hand support; a ring having an attachment for receiving the distal end of the torsional spring, the attachment being located at a distal location on a phalanx of the hand, the torsional spring applying a torque at the attachment to have the phalanx flex inwardly with respect to the hand support.

According to an embodiment, the torsional spring comprises a spring coil being located on a joint proximal the phalanx.

According to an embodiment, there is further provided a pad under the ring to mitigate the discomfort of the ring.

BRIEF DESCRIPTION OF THE DRAWINGS

Further features and advantages of the present disclosure will become apparent from the following detailed description, taken in combination with the appended drawings, in which.

It will be noted that throughout the appended drawings, like features are identified by like reference numerals.

DETAILED DESCRIPTION

The existing devices mentioned above fail to address finger movement one phalanx at a time and therefore fail to provide a useful solution for object handling and gripping.

The apparatus described herein is used to assist gripping and holding objects in the hand. Holding is to be performed with minimal effort, the user's force being rather needed for releasing the object being held.

Figure 1:
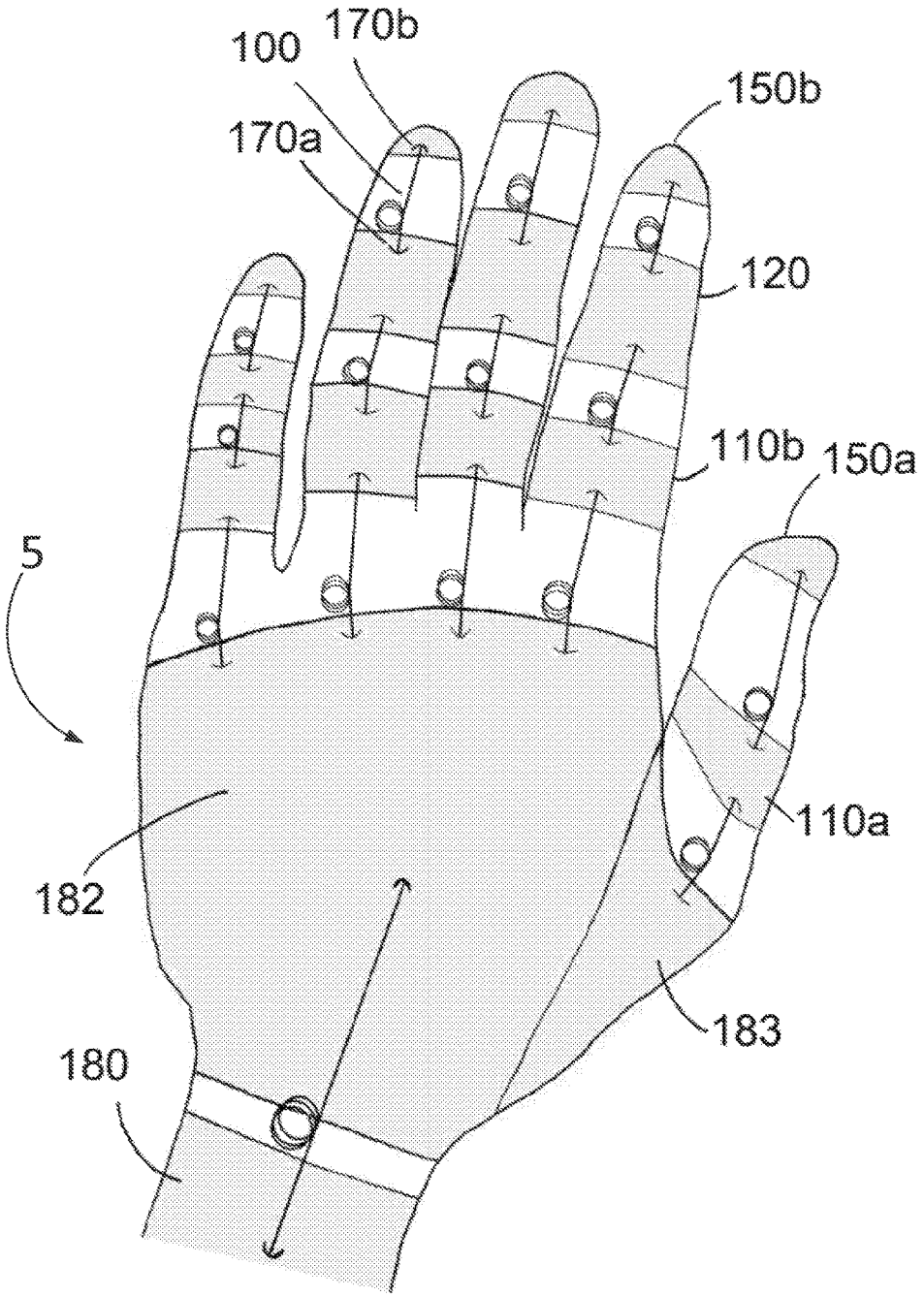
FIG. 1 is a cross-section of the hand illustrating the parts of the hand that serve as reference points for a strength-enhancing apparatus.

FIG. 1 shows an embodiment of the apparatus 5 installed on a left hand of a user. Various parts of the apparatus 5 are adapted to be placed on specific parts of the hand, the parts of the hand being described in FIG. 2. The purpose of the apparatus is to assist the user in gripping tasks by using pre-deformed biasing devices (i.e., the default position is not straight) which provide gripping force when the hand is at rest (i.e., the hand is in a closed position by default and force needs to be applied to open the hand). The biasing devices are inversed V-shaped hinge-type biasing devices which are in their V-shape at rest and for which force needs to be applied from within to open the biasing device and make it straighter. The description below and the accompanying figures show embodiments to effectively assist in gripping tasks. Since gripping tasks involve the pivot of phalanxes with respect to joints, the hand anatomy needs to be described in order to explain how the apparatus 5 is installed with respect to joints.

Figure 2:
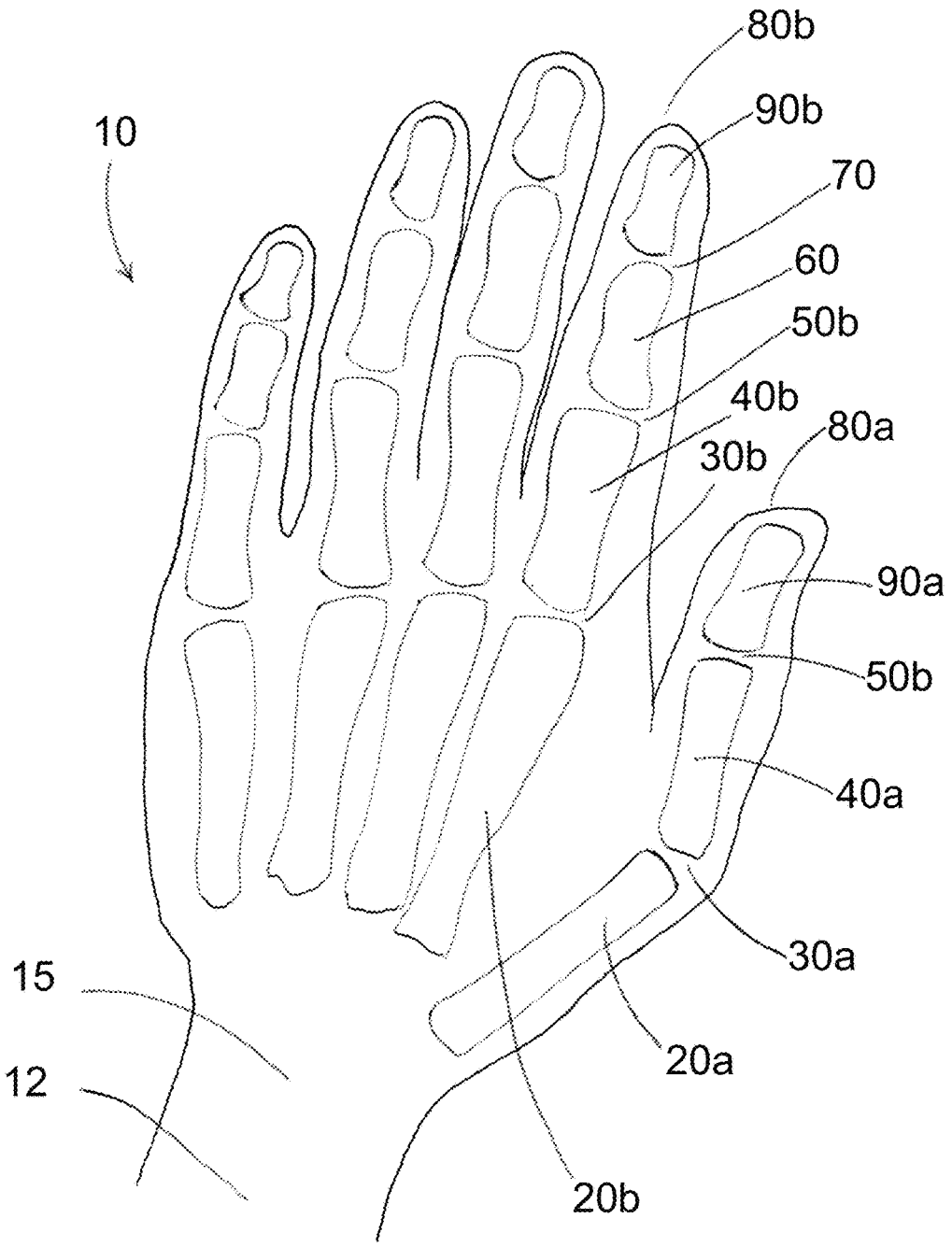
FIG. 2 is a front view of a strength-enhancing apparatus provided on a hand, according to an embodiment.

FIG. 2 shows bones and joints to which the description of the apparatus 5 will refer. The hand 10 comprises five fingers, including the thumb and four other opposing fingers. Each one of the five fingers has a metacarpal bone (inside the hand). The thumb has a thumb metacarpal bone 20*a*, for which limited movement is possible. Each one of the other fingers has a finger metacarpal bone 20*b* which cannot move substantially.

Each one of the five fingers has a proximal phalanx. The thumb has a proximal phalanx 40*a*, for which limited movement is possible. Each one of the other fingers has a proximal phalanx 40*b*. The proximal phalanges (40*a*, 40*b*) are joined to the metacarpal bones (20*a*, 20*b*) at the metacarpophalangeal joint (30*a*, 30*b*). This articulation forms a hinge around which the proximal phalanges (40*a*, 40*b*) can rotate or pivot, either in flexion (the hand is closing) or in extension (the hand is opening).

The fingers have an intermediate phalanx 60 which is distal relative the proximal phalanx 40*b*. The proximal interphalangeal joint 50*b* joins these phalanges and forms a hinge around which the intermediate phalanx 60 can pivot during flexion or extension. The thumb does not have any intermediate phalanx.

All fingers, including the thumb, have a distal phalanx (90*a*, 90*b*). The thumb's distal phalanx 90*a* is joined to the thumb's proximal phalanx 40*a* by the thumb's interphalangeal joint 50*a*, which forms a hinge around which the distal phalanx can pivot.

The four other fingers which are opposing the thumb have a distal phalanx 90*b* which can pivot around the hinge formed by the distal interphalangeal joint 70, which joins the distal and intermediate phalanges together. Adduction and abduction of fingers need not be considered since these movements do not involve significant forces during gripping.

During a gripping movement, all fingers, or at least most fingers, flex. This movement involves the pivot of each phalanx around the most proximal joint to which they are attached. Fingers have three joints, except the thumb which only has two. However, the thumb metacarpal bone 20*a* can move with respect to the wrist 15 to improve the adaptability of the movement, while that of the other fingers cannot.

Moreover, each finger has a fingertip (80*a*, 80*b*) and the distal end thereof. For pinching or precision gripping, the thumb's fingertip 80*a* can be put in opposition with the fingertip 80*b* of any other opposing finger.

Furthermore, the hand extends from the wrist 15. The wrist also acts as a hinge around which the hand can pivot during a flexion/extension movement. Furthermore, the wrist also forms a hinge enabling lateral flexion/extension of the hand relative to the wrist.

Now referring back to FIG. 1, there is illustrated the apparatus 5 for enhancing gripping strength. The apparatus 5 comprises various rings which surround fingers at specific locations. The rings are attached by biasing devices which take the form of a spring 100. According to an embodiment, the springs 100 are torsional springs, as illustrates in FIGS. 1 and 3-4. In order to assist in gripping (i.e., enhancing gripping strength), the torsional springs are pre-loaded. It follows that when the apparatus 5 is installed on the user's hand at rest, the fingers are forced to flex, i.e., the hand is forced to close. Gripping is effortless (or requires less effort than normally), while opening the hand requires opening strength exerted by the fingers (i.e., the user must force to open their hand to have their fingers adopt a straight position).

The surface of the hand of the user is covered with a hand support 182. The hand support is shaped so as to cover the surface of the hand and has a proximal end close to the wrist, as shown in FIG. 1. The figure further shows that the hand support extends to various parts of the hand, more specifically, to the base of each finger.

The hand support 182 acts as a main support for the most proximal springs 100, which extend from the hand support 182 to the proximal phalanx ring (110*a*, 110*b*). To act as a proper support, the hand support 182 must be firmly held in place on the hand of the user. For example, the hand support 182 may extend laterally on the sides of the hand to reach at least in part the palm of the hand. Surrounding the hand, at least partially, aids in providing a good support. According to another embodiment, the hand support 182 may not need to surround the hand if the hand support 182 is a part of a glove (as described below), which itself covers the whole hand of the user.

Figure 3:
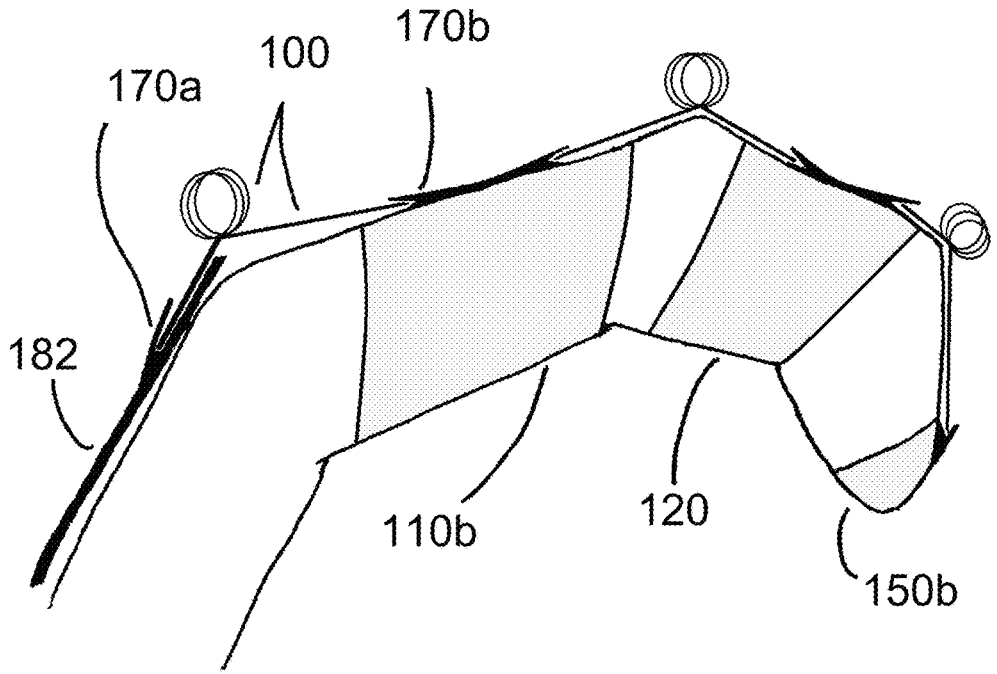
FIG. 3 is a side view illustrating the forces being applied on the fingers by the strength-enhancing apparatus, according to an embodiment.
Figure 4:
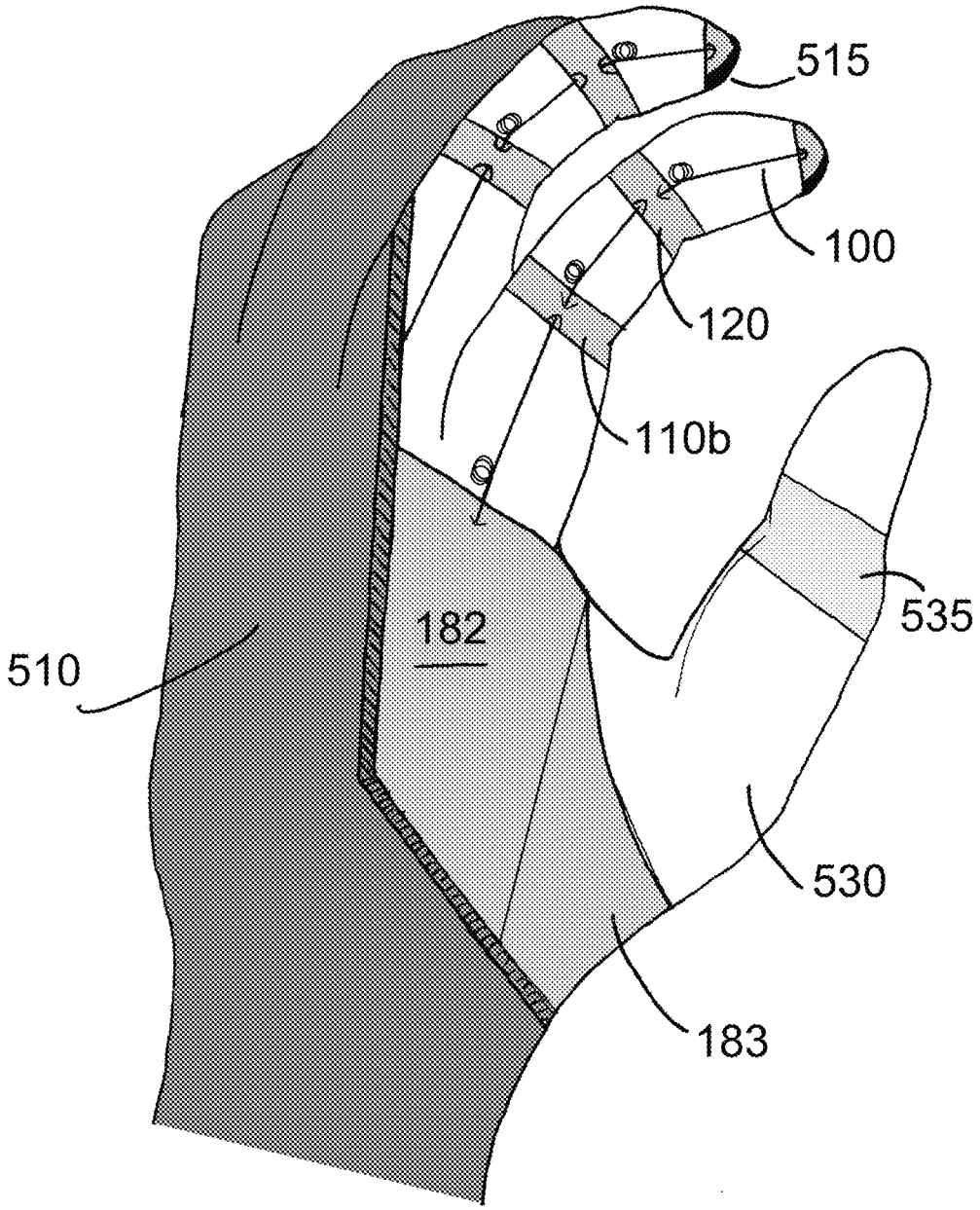
FIG. 4 is a perspective view of the layers forming a glove for embedding the apparatus, according to an embodiment.

As a general matter, to assist the user in gripping, a torque needs to be applied to the fingers, and more specifically, to the bones making up the fingers. Referring now to FIG. 3, the torque is applied by the spring 100 on a location of the phalanx (or on a range of locations). To be effective, the torque is applied at a distal location on the phalanx. Applying the torque to a less distal location on the phalanx would work, but would be less effective. Therefore, the distal spring anchor 170*b* is preferably located at a distal location on the phalanx, since this is the point where the torque is applied. This torque is applied with reference to a more proximal location, which of course needs not to be on the same phalanx. This reference for the torque applied on the finger is the joint which is proximal to the location where the force is being applied. The spring 100 itself takes support at a location close to the joint, the proximal spring anchor 170*a*, from where the spring stems. The proximal spring anchor 170*a* is usually placed proximal the joint which is proximal the phalanx so that the circular part of the torsion spring 100 is very close to the joint, as shown in FIGS. 1 and 3-4. FIG. 3 shows clearly how the spring 100 comprises a circular portion located above a joint which induces a torque. This spring is anchored at a proximal spring anchor 170*a* for holding (or supporting) the spring and at a distal spring anchor 170*b* where the spring 100 presses on the finger, which is therefore the location where the force of the torque is applied.

Since the gripping movement involves a pivot of the proximal phalanx (40*a*, 40*b*) relative to the metacarpophalangeal joint (30*a*, 30*b*), a proper assisting device needs to force the proximal phalanx (40*a*, 40*b*) relative to the metacarpophalangeal joint (30*a*, 30*b*). To do so, a force must be applied at a (preferably distal) location on the proximal phalanx (40*a*, 40*b*) or on a range of locations thereon to create a torque. This torque-generating force is applied at the proximal phalanx ring (110*a*, 110*b*) location. Therefore, for the thumb, the proximal phalanx ring 110*a* must be located on the proximal phalanx and preferably extend up to the interphalangeal joint 50*a*, and ensure that the torque is exerted at a location proximal the interphalangeal joint 50*a*. The torque-generating force is exerted by the spring 100 which has its distal end connected to the proximal phalanx ring (110*a*, 110*b*). This spring 100 has a proximal end which is connected to the hand support 182 (or 183) which acts as a support. The spring 100 is connected to both the proximal phalanx ring 110*b* and the hand support 182 by spring anchors (170*a*, 170*b*). The spring anchor (170*a*, 170*b*) is any type of attachment which can hold an end of the spring 100, such as a hook. A small depression or pocket in which the extremity of the spring is held may also work as an alternative for the attachment.

According to an embodiment, all (or many) springs 100 covering one of the fingers constitute a unique spring 100. The spring anchors (170*a*, 170*b*) on a given ring form, in combination, a long two-ended pocket, or tunnel, through which the elongated parts of the spring 100 are passed. The springs 100 of FIG. 1 can be thought as such. According to anther embodiment, springs 100 are indeed distinct and spring anchors (170*a*, 170*b*) is where the springs 100 start and end.

According to another embodiment, springs 100 for a given finger constitute a unique spring which is held on top of the finger by the glove 510 surrounding the hand (described further below) and no spring anchor (170*a*, 170*b*) is required. The torque is applied on a continuous range of locations on the finger by the elongated part of the spring 100 which leans on parts the phalanxes.

The spring 100 which connects the hand support 182 to the proximal phalanx ring (110*a*, 110*b*) must be supported by its most proximal spring anchor 170*a*, i.e., the anchors of the hand support 182, at a location which will enable an effective torque to be applied at the distal end of the proximal phalanx (40*a*, 40*b*). To this end, the most proximal spring anchor 170*a* is located proximal the metacarpophalangeal joint (30*a*, 30*b*) so that the circular portion of the torsion spring 100, i.e., the part which forms the hinge, is located approximately on the metacarpophalangeal joint (30*a*, 30*b*). For this reason, each proximal spring anchor 170*a* provided on the hand support 182 is located slightly proximal the metacarpophalangeal joint (30*a*, 30*b*) of the corresponding finger. This is shown in FIGS. 1 and 3.

FIGS. 1 and 3 show additional rings located more distally. The location at which the rings and spring anchors (170*a*, 170*b*) are provided follows the same reasoning applied above. Each finger but the thumb has an intermediate phalanx 60 on which the intermediate phalanx ring 120 is located. More precisely, the intermediate phalanx ring 120 is located proximal the distal interphalangeal joint 70 and preferably extends up to the distal interphalangeal joint 70 itself or close to it, where the proximal spring anchor 170*a* for the following spring 100 is located. The purpose of the intermediate phalanx ring 120 is to apply the torque preferably close to the distal end of the intermediate phalanx 60 to have it pivot around the proximal interphalangeal joint 50*b*. Therefore, the intermediate phalanx ring 120 comprises a distal spring anchor 170*b*. The torque on this specific spring anchor 170 is applied by a spring 100 which has its proximal end attached to a more proximal spring anchor 170*a*, which is itself located on the proximal phalanx ring 110*b*. Since the proximal phalanx ring 110*b* is located completely on the proximal phalanx 40*b*, but only slightly proximal the proximal interphalangeal joint 50*b*, this is an effective location for supporting the spring 100 which is intended to apply the torque at the distal location on the intermediate phalanx 60. (Since the thumb does not have any intermediate phalanx, there is no intermediate phalanx ring 120 on the thumb.) Again, the circular portion of the spring 100, from which the torque originates, is provided above the proximal interphalangeal joint 50*b* (as shown in FIG. 3 where the middle spring coil is above the proximal interphalangeal joint) so that the force that generates the torque is applied on the intermediate phalanx ring 120.

The same applies to the finger cap (150*a*, 150*b*), which is installed on the fingertip (80*a*, 80*b*). The finger cap (150*a*, 150*b*) is provided at the distal end of the distal phalanx (90*a*, 90*b*). It provides a location at which a torque-generating force may be applied with respect to the previous joint (proximal the fingertip), i.e., either the interphalangeal joint 50*a* for the thumb or the distal interphalangeal joint 70 for the other fingers. The finger cap (150*a*, 150*b*) comprises a distal spring anchor 170*b* where the spring 100 is held and where it applies the force. This spring 100 is supported by a more proximal spring anchor 170*a* located on the ring slightly proximal the previous joint.

According to an embodiment, the rings (110*a*, 110*b*, 120) need to be rigid to ensure that the distal spring anchor 170*b* of the previous (more proximal) spring 100 and the proximal spring anchor 170*a* of the next (more distal) spring 100, which lie on the same ring, are fixed in relation with the other one. According to an embodiment, the ring encircles the whole circumference of the finger. According to an embodiment, the ring does not encircle the whole circumference of the finger, rather a substantial portion thereof. According to another embodiment, the rings (110*a*, 110*b*, 120) are rather made of fabric (or a similar woven or non-woven material) and the spring anchors are one-ended pockets, or two-ended pockets (tunnel), or fabric hooks, etc., so the rings need not be rigid.

According to an embodiment, the apparatus 5 comprises a wrist support 180. The wrist support 180 is a solid piece of material that is installed on the forearm of the user. According to an embodiment, the wrist support completely surrounds the forearm. According to another embodiment, the wrist support 180 surrounds only a portion of the forearm, or includes two or more separate subportions which are firmly held together by fasteners.

The wrist support 180 has a proximal end (not shown) which does not reach the elbow, since covering the elbow would render this joint inoperable. The wrist support 180 further comprises a distal end which is located approximately at the wrist, as shown in FIG. 1. Preferably, the wrist support 180 does not extend past the wrist on the hand. If the wrist support 180 extends past the wrist, it prevents the hand to be bent up and down relative to the forearm. For some applications, completely preventing the bending of the hand is desirable, however, for most applications, at least some freedom to bend the hand will be preferred.

According to an embodiment, the hand support 182 and the wrist support 180 are free to move relative to the other one: they are separate and unconnected. According to another embodiment, they form a unique and integral piece: the wrist movement is thereby prevented. According to another embodiment, a biasing device is provided between these two parts to provide a negative feedback when a pivotal movement is initiated. More specifically, a spring 100, which can be a torsional spring as elsewhere on the apparatus, is provided between the hand support 182 and the wrist support 180. If a pressure is applied on the hand which would have the consequence of bending the wrist, the spring 100 can absorb the shock and compensate the external force that is applied. Doing so prevents the wrist from undergoing severe bending which could hurt the person performing the heavy work. Contrarily to the other springs which are preloaded to apply a torque on the fingers when they are at rest, the spring 100 supporting the hand-wrist articulation is not pre-loaded or pre-deformed. It stays in a comfortable position when at rest (essentially in a straight position), and absorbs mechanical energy when it is being bent, such as when a shock is undergone by the whole hand relative to the wrist. Since this spring is in equilibrium when approximately straight, it can absorb energy when it is bent it either directions, so it can protect the hand in both flexion and extension at the same time (as shown in FIG. 2). It avoids the need for placing a spring which would terminate in the palm of the hand, which would be inconvenient. As an additional or alternative configuration, one or two springs can be provided on one or two sides of the wrist to prevent lateral flexion/extension of the wrist. However, this particular configuration limits the freedom of movement of the working person more substantially.

According to an embodiment, the hand support 182 comprises a mobile part, namely the thumb metacarpal bone support 183 (aka thumb support). Although it is possible to have a unique hand support 182 covering the whole surface of the hand, it has the disadvantage to prevent the movement of the thumb metacarpal bone 20*a*. This bone is nonetheless solicited during some types of grabbing movement, especially if the thumb's fingertip 80*a* needs to reach a specific location. For this reason, a rigid plate covering the thumb metacarpal bone 20*a* together with the palm is not preferred. The thumb metacarpal bone support 183 may be made of the same material as the hand support 182. It is rigid in order to provide adequate support to the spring 100 which acts on the thumb. The thumb metacarpal bone support 183 is mechanically connected to the hand support 182 by a hinge or other type of mechanical connector that can allow some movement. For example, the border between the hand support 182 and the thumb metacarpal bone support 183 may be approximately located along the axis which separates the thumb metacarpal bone 20*a* and the finger metacarpal bone 20*b* of the index. A hinge provided roughly along that axis, as shown in FIG. 2, can provide the necessary rotatability of the thumb metacarpal bone support 183 with respect to that axis. The most proximal spring anchor 170*a* of the thumb, namely the thumb anchor, can be provided on the thumb metacarpal bone support 183 to ensure a proper support for the biasing devices 100 that extend along the thumb from the thumb metacarpal bone support 183.

According to an embodiment, the apparatus 5 is provided in a glove 500 as shown in FIG. 4. The glove 500 comprises multiple layers. According to an embodiment, the glove 500 comprises an outer glove 510 which covers the whole hand, or a substantial portion thereof. This is illustrated in FIG. 4, wherein the outer glove 510 is shown as covering the left and bottom portion of the hand (the figure shows what is beneath the outer glove 510 for the remainder of the hand). The outer glove hides the underlying parts, also shown in FIG. 4 for the middle finger and index. According to an embodiment, the outer glove 510 comprises gripping pads 515. The gripping pads 515 are pads made of a material with a high friction coefficient in order to enhance adherence of the outer glove 510 with the surface of what is being grabbed to provide a better gripping. The apparatus 5 is installed inside the outer glove 510. According to another embodiment, the gripping pads 515 are provided on the finger caps (150*a*, 150*b*) instead of, or in addition to, the gripping pads 515 on the outer glove 510.

Furthermore, the use of the outer glove 510 is advantageous in that it protects the surroundings (e.g., the objects being manipulated, the arms of the person, or other people) to be scratched, hurt or otherwise damaged by some parts of the apparatus 5 (e.g., springs).

According to another embodiment, there is provided an inner glove 530. The thumb in FIG. 4 is shown with the outer glove 510 and the rings and springs removed, so that the inner glove 530 can be seen. The inner glove 530 is in direct contact with the hand skin and is preferably made to be comfortable. The inner glove 530 protects the skin; it prevents it from being touched by solid parts of the apparatus, such as the springs 100 or the rings (110*a*, 110*b*, 120). According to an embodiment, the inner glove 530 has absorbing pads 535 mounted thereon, illustrated for the thumb in FIG. 4. The absorbing pads 535 are cushions which are placed beneath the rings (110*a*, 110*b*, 120) and absorb the torque-generating forces exerted by these rings on the fingers. Since rings are made of a solid and rigid material (such as a metal or a plastic), they can become uncomfortable. The presence of a cushion between those rings and the fingers renders the apparatus 5 more comfortable to wear and use and protects the user.

According to an embodiment, the outer glove 530 comprises apertures or protuberances to leave space for the circular portion of the torsion springs which extend away from the finger joints (this configuration is not shown).

It will be understood that while the current description and accompanying drawings are about a torsion spring which has a circular winding for applying a torque (as in a scarf pin), other types of biasing devices can be used. The requirement is that the biasing device is placed substantially above a joint and provides a torque between both sides of that joint, as if the finger was being bitten on both sides of the joint by an inversed V-shaped biasing device.

According to an embodiment, springs 100 are provided only above interphalangeal joints.

According to an embodiment, the apparatus 5 comprises rings for only some of the fingers instead of all five fingers. For example, if the apparatus 5 is to be used in specific tasks which only require the thumb and index to pinch something, then the apparatus may comprise rings for only the thumb and the finger. The glove 500 may be adapted consequently. For other tasks, the little finger and/or the ring finger and/or the middle finger may be left without any ring (110*b* or 120) or finger cap 150*b* thereon. For other tasks, the thumb might not be needed, so it may be left without any ring 110*a* or finger cap 150*a*.

According to an embodiment, some or all of the fingers have their distal phalanges free from rings 120 and finger caps (150*a*, 150*b*).

While preferred embodiments have been described above and illustrated in the accompanying drawings, it will be evident to those skilled in the art that modifications may be made without departing from this disclosure. Such modifications are considered as possible variants comprised in the scope of the disclosure.

The invention claimed is:

1. An apparatus for installation on a hand having a thumb and opposable fingers, both having joints and phalanges, the apparatus comprising:

biasing devices, each one of the biasing devices substantially having an inversed V-shape defining a hinge, a distal end and a proximal end, wherein the biasing devices are connected together to form the apparatus, the biasing devices being spatially distributed so that each one of the hinges covers a corresponding one of the joints of the opposable fingers, wherein each one of the hinges is located at an apex of the inversed V-shape of a corresponding one of the biasing devices, between the distal end and the proximal end and substantially distant therefrom, whereby a torque applied by each one of the hinges at the apex of the inversed V-shape acts to close the inversed V-shape and thereby to force the distal end and the proximal end closer together.

2. The apparatus of claim 1, wherein the biasing devices to be installed on one of the thumb and the opposable fingers are integrally connected.

3. The apparatus of claim 1, wherein the biasing devices to be installed on one of the thumb and the opposable fingers are distinct and connected by a ring between each one of the biasing devices, each ring being for installation one of the phalanges.

4. The apparatus of claim 1, further comprising a hand support substantially covering an outer portion of the hand, the hand support comprising anchors, wherein there is at least one biasing device on each opposable finger and a most proximal ones of the at least one biasing devices of each opposable finger is connected to the hand support via a corresponding one of the anchors.

5. The apparatus of claim 4, further comprising a thumb support substantially covering a thumb metacarpal bone, the thumb support being hingedly connected to the hand support and comprising a thumb anchor, wherein there is at least one biasing device on the thumb and a most proximal ones of the biasing devices of the thumb is connected to the thumb support via the thumb anchor.

6. The apparatus of claim 1, wherein each one of the biasing devices comprises a torsional spring comprising a coil portion loaded in torsion at the hinge thereof.

7. The apparatus of claim 1, further comprising an inner glove to act as a protecting layer between the biasing devices and the hand.

8. The apparatus of claim 7, further comprising an outer glove to act as a protecting layer over the biasing devices.

9. The apparatus of claim 1, further comprising a ring between each one of the biasing devices, wherein the biasing devices to be installed on a given finger are distinct and connected by the ring, each ring being for installation one of the phalanges, each ring being for at least one of:

providing the supporting base for one of the biasing devices; and providing the location where the force is exerted by another one of the biasing devices.

10. An apparatus for assisting in gripping an object by a hand, the apparatus comprising:

a hand support for covering a portion of a surface of the hand;

a torsional spring having a proximal end and a distal end, the proximal end being fixed and located on the hand support, the torsional spring comprising a coil portion between the proximal end and the distal end and distant therefrom, the coil portion forming a hinge at an apex of an inversed V-shape defining the hinge of the torsional spring and being loaded in torsion to apply a torque at the apex to close the hinge of the torsional spring and thereby to force the distal end and the proximal end closer together;

a ring having an attachment for receiving the distal end of the torsional spring, the attachment being located at a distal location on a phalanx of the hand, the torsional spring applying the torque at the attachment to have the phalanx flex inwardly with respect to the hand support.

11. The apparatus of claim 10, wherein the hinge is located on a joint proximal the phalanx when the apparatus is operated.

12. The apparatus of claim 10, further comprising a pad under the ring to mitigate a discomfort of the ring.

* * * * *